United States Patent [19]

De brey et al.

[11] 4,073,533

[45] Feb. 14, 1978

[54] FOOD HANDLING TONGS

[76] Inventors: Robert J. De brey, 4502 Browndale Ave., Edina, Minn. 55424; Richard S. Thom, 7941 Colorado Ave., Brooklyn Park, Minn. 55443

[21] Appl. No.: 668,593

[22] Filed: Mar. 19, 1976

[51] Int. Cl.[2] ..... B25B 5/04

[52] U.S. Cl. ..... 294/118

[58] Field of Search ..... 294/118, 1 R, 16, 8.5, 294/106, 31; 128/305, 321, 322, 323, 324; 30/194, 232, 193, 260; 76/104 A; D7/209; D8/4, 5, 52, 54; D86/10 B; D95/3 R

[56] References Cited

U.S. PATENT DOCUMENTS

| | | | |
|---|---|---|---|
| D. 20,422 | 12/1890 | Pearsall | D8/57 |
| 818,465 | 4/1906 | Price | 294/118 |

FOREIGN PATENT DOCUMENTS

| | | | |
|---|---|---|---|
| 742,955 | 1/1933 | France | 294/99 R |

*Primary Examiner*—James B. Marbert

*Attorney, Agent, or Firm*—James R. Cwayna

[57] ABSTRACT

An improvement in tongs such as those utilized for the handling of foods and the like including a scissor connection for longitudinally extending grasping elements and handle elements. The grasping elements provide substantially partially spherical shaped food retaining devices having drainage openings formed therethrough and having the lower most ends thereof providing extensions to provide pincers for the grasping of relatively small articles therebetween. The handle portions of the tongs are provided with longitudinally arranged finger receiving openings such that the unit is usable in and operable in a longitudinal attitude as compared to a transverse or side operative position.

9 Claims, 6 Drawing Figures

FOOD HANDLING TONGS

FIELD OF THE INVENTION

This invention relates generally to tongs or grasping elements and more particularly to food handling tongs of a dimension that will allow their usage for the insertion of foods into deep, relatively narrowmouthed receptacles.

BACKGROUND OF OBJECTS OF THE INVENTION

The canning and preserving of foods is an art that has long been known and for various reasons, there has been a resurge of interest in the same. Those acquainted with this art realize the importance of proper handling of the food and the difficulties in placing the food into canning jars without damaging the same. Canning jars are normally of a relatively thin mouth design and are substantially deep in relation to their opening. It is normally difficult for a person to insert his hand into a jar for the proper placement of the food. The food should not be dropped into the jar but should be placed therein with a minimum amount of bruising.

These various requirements demand a unit which will allow for the grasping of the food articles for placement into a jar in a manner which does not damage the foods and which will allow the canner to place the articles into the bottom of a jar and pack the same gently and in aesthetically proper position therein.

Applicant has therefore provided food handling tongs which provide a substantially spherically shaped grasping portion for holding the food item and having a handle portion arranged opposite a scissors or pivotal connection between longitudinal support members of the tongs which permits the user's hand to be in longitudinal alignment with the food handling portion rather than off to the side thereof.

It is therefore an object of applicant's invention to provide a pair of food handling tongs which includes a generally spherically shaped food grasping portion for grasping of foods and insertion thereof into storage or canning receptacles.

It is a further object of applicant's invention to provide a pair fo food handling tongs having a lower food grasping portion which food grasping portion provides a fluid drainage means.

It is a further object of applicant's invention to provide food handling tongs particularly designed for the grasping and handling of food articles which includes a pair of generally spherically-shaped food-grasping portions having opposed extensions thereon which opposed extensions provide pincer means for the grasping of relatively smaller articles such as the lids for sealing the canning receptacle.

It is a further object of applicant's invention to provide food handlign tongs which include means to receive the fingers longitudinally therein such that the unit may be worked and pressure applied thereto from longitudinal directions rather than transverse directions.

It is still a further object of applicant's invention to provide food handling tongs of substantial length to enable food grasped thereby to be inserted into the bottoms of deep, relatively narrow mouthed receptacles.

It is still a further object to provide a tong device for grasping articles such as lids for canning receptacles such that the lids will be held through multipoint contact thus preventing rotation of the lid as would be available with two point contact.

It is still a further object to provide a tong device having finger receiving apertures providing for vertical use of the tongs with the weight being directed longitudinally of the fingers and the apertures providing a wedging, lever action for the improvement of finger grasping.

These and other objects and advantages of the invention will more fully appear from the following description made in connection with the accompanying drawings in which the same numeral is used to designate the same or similar parts throughout the several views, and in which:

FIG. 1 is a perspective view of a pair of food handling tongs embodying the concepts of applicant's invention and illustrating the same placing a food article into a canning jar or the like;

Figure 1:
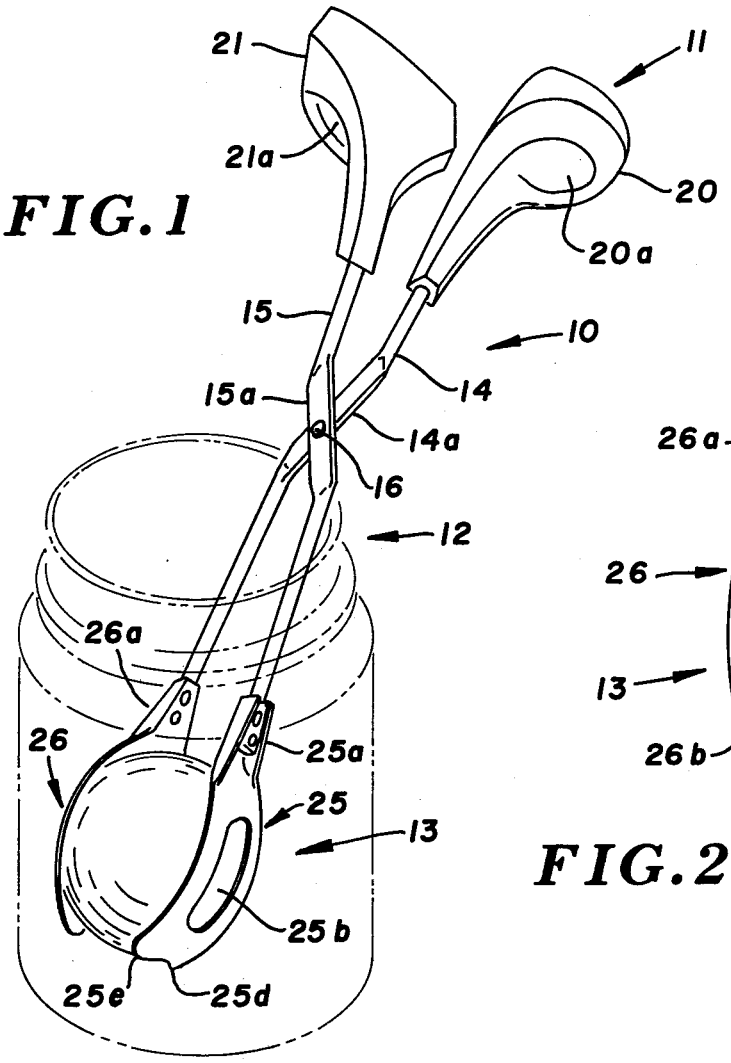

In accordance with the accompanying drawings, applicant's food handling tongs are generally designated 10 and include a handle portion 11, a longitudinally extending strut section 12 and a food grasping portion 13 arranged at the lower end of the strut section 12.

In the form shown, the strut section 12 includes a pair of longitudinally extending support members 14, 15 which may be substantially round in shape and which are flattened at a selected portion longitudinally thereof such as at **14*a*, 15*a* to provide a connection area with a joinder member 16 passing therethrough such that the supports 14, 15 are joined in a scissors-like arrangement. Obviously, the upper and lower ends of the supports 14, 15 will normally be in parallel relation when the unit is completely closed and therefore the flattened portions 14*a*, 15*a* will, in addition to being flattened and providing a connection, provide an offset between the upper and lower portions of the supports 14, 15**.

Arranged at the upper ends of the supports 15, is the handle portion 11 which includes a pair of finger receiving receptacles 20, 21. These receptacles are so arranged that the finger receiving apertures **20*a*, 21*a* thereof are in general longitudinal alignment with the respective supports 14, 15 to which they are connected. Handle portion 20 provides a single, substantially round finger passage 20*a* such that a person's thumb would be received therein in substantial alignment with the support 14 while the handle portion 21 provides a substantially flat or oval-shaped passage 21*a* such that several fingers may be received longitudinally therein in alignment with the support 15. It should be obvious that the particular shape of the aperture 21*a* is not a governing factor and could be modified to receive one or several fingers therein. The basic concept of these finger receiving and thumb receiving passages is to provide an anatomical design such that the tongs will work as an extension of the fingers rather than utilizing a normal scissors-like handle in which the fingers are received into side opening passages and a further description of aperture 21***a* and the reasoning for the shape thereof will appear hereinafter.

The food handling portion 13 consists of a pair of identical and oppositely disposed tong elements designated respectively 25, 26. The upper ends 25*a*, 26*a* of these elements 25, 26 are rigidly joined to the lower ends of the supports 14, 15 but it should be obvious that these tong elements 25, 26 and supports 14, 15 could be formed as a single piece without such required attachment.

Figure 4:
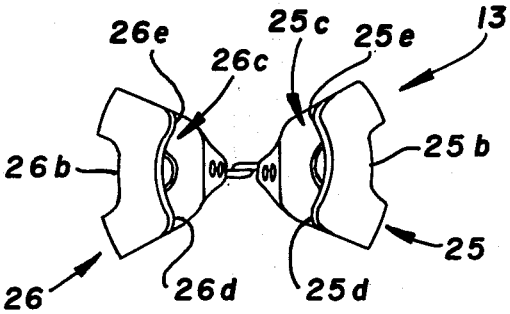
FIG. 4 is a bottom plan view taken substantially along Line 4—4 of FIG. 3 again illustrating the food grasping portions of the tongs.
Figure 3:
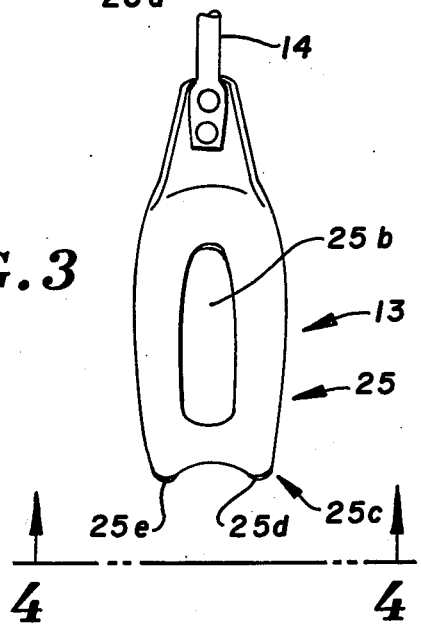
FIG. 3 is a side elevation taken from one side of the food grasping portion of the tongs.

As particularly illustrated in FIGS. 3 and 4, the grasping elements 25, 26 taper outwardly from the supports 14, 15 to provide a substantially rectangular configuration which rectangular configuration provides a radius along at least the inner surfaces 27, 28 of the elements 25, 26. From an ease of construction, these food grasping elements 25, 26 are formed from a relatively thin plate material and therefore the exterior surfaces of these portions 25, 26 will be similarly curved.

Figure 2:
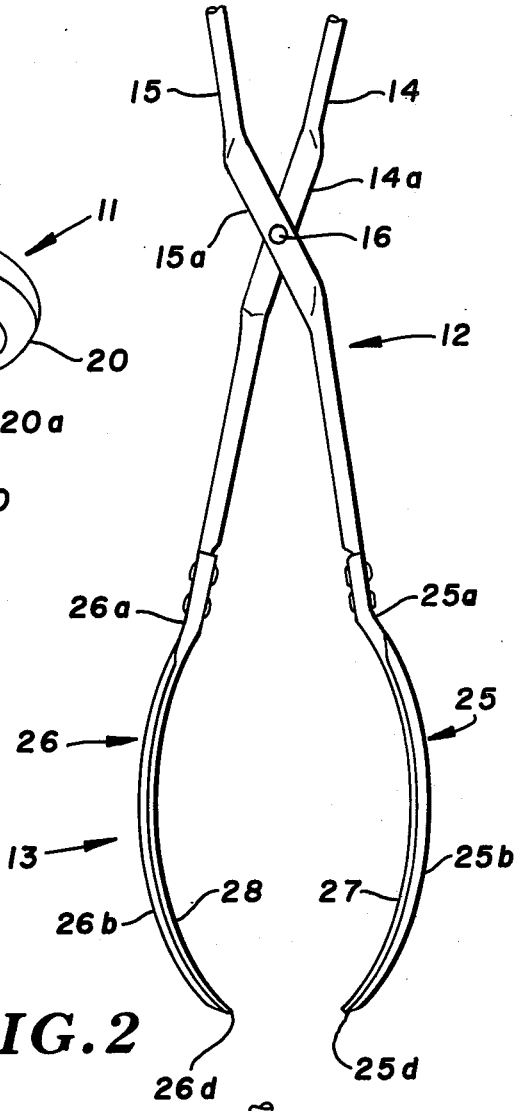
FIG. 2 is a front elevation of a portion of the tongs as illustrated in FIG. 1 and particularly illustrating the food grasping lower portions thereof.

As particularly illustrated in FIGS. 2 and 4, the food grasping elements 25, 26 are also curved in a longitudinal direction. This combined curvature provides, in the form shown, a portion of an oblate spheroid, although this particular shape should not be considered to be limiting other than considering a dual curvature feature.

An opening 25*b*, 26*b* is formed respectively through the grasping elements 25, 26 and these openings 25*b*, 26*b* are substantially rectangular in configuration and provide drainage areas patially longitudinally and partially circumferentially about the grasping portions 25, 26.

The lower ends 25*c*, 26*c* of the grasping elements are each provided with at least one longitudinally extending pincer element such as 25*d*, 25*e*, 26*d*, 26*e* such that when the tongs are in their closed position, these extensions will abut with one another and these areas of contact will permit the grasping of relatively small articles such as can cover lids and the like. Obviously it would not be necessary to provide two such extensions on each food handling element; one such extension would be sufficient to provide the pincer technique desired or various combinations of such extensions could be provided on the respective ends of these food grasping devices to accomplish this same result but an advantage for lid or cover lifting is obtained with the multipoint arrangement shown. In the form shown, the area between the extensions 25*d*, 25*e*, 26*d*, 26*e* is concabely radiused for a multipoint grasping arrangement. The radius is less than the radius of a cover such that four point contact is maintained on the periphery of the cover and therefore the cover cannot rotate as it could with a two point contact. The flexibility of the supports 14, 15 also insures the multipoint contact. With this type of lifting unit, the lid is lifted only along the exterior circumference and therefore no damage will be done to the rubber seal arranged on the face of the cover.

Figure 5:
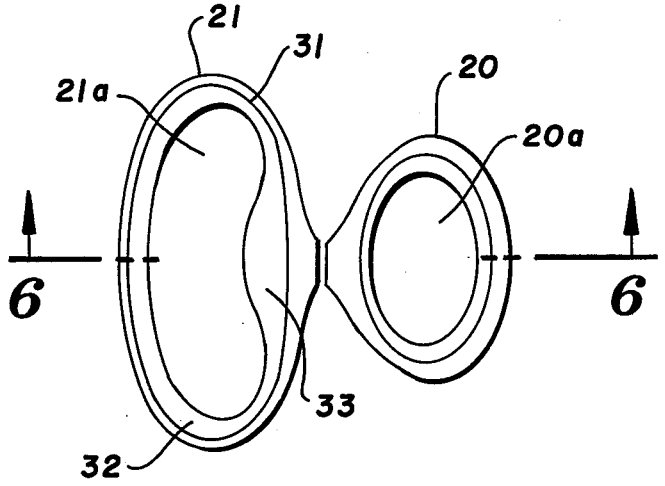
FIG. 5 is a top plan view of the tongs particularly illustrating the handles with the finger receiving apertures; and, FIG. 6 is a vertical section taken substantially along Line 6—6 of FIG. 5 and illustrating the user's fingers in the aperture thereof.
Figure 6:
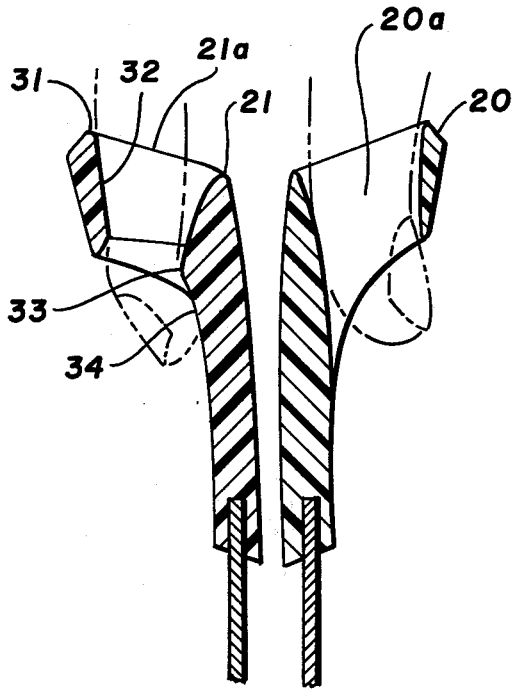

The configuration of the handles is best shown in FIGS. 5 and 6. In these views, portion 20 illustrates the thumb receiving aperture 20*a* which provides a generally elliptical passage for receipt of the thumb and portion 21 illustrates the finger receiving aperture 21*a* which forms a generally elliptical entrance area 31 having a downwardly and inwardly tapering sidewall 32 having an inwardly directed depressed area 33 formed on the sidewall nearest the thumb receiving portion 20. The area below this depressed area 33 is curved radially outwardly as at 34 to provide a finger grasping ledge. As illustrated in FIG. 6, the users finger tips will extend through the aperture 21*a* and lock about the ledge area and this will cause a wedging effect on the back of the fingers against the sidewall opposite the ledge area. The locking, wedging effect will provide a substantially in-line result for lifting the weight of the unit on the tips of the fingers engaging the ledge.

The use of the food handling tongs should be obvious to anyone skilled in the food handling art and particularly those skilled in the canning art, in that the longitudinal force application permitted by the handles allows the user to act directly over and in line with the mouth of the jar rather than acting from a side position. This has an advantage in the placing of food into jars. The curved food grasping portions are designed to permit the grasping of foods gently by providing an area between the grasping members even when they are in the closed position in that the curved portions of the food grasping portions will be spaced from each other when the lower most ends thereof are in contact. This shape also allows the user to gently grasp a slippery or wet food article in that a basket shape is provided by the tongs rather than providing tongs which would apply pressure at one point on the food as would be the case if the tongs or the food handling portions were not so curved.

The drainage apertures allow the food to be drained before insertion into the jars. The pincer like ends of the tongs also provide a means for positively grasping articles and this is important such as in withdrawing lids from hot water. One further aspect of applicants invention is the utilization of material for the handles such as plastic or the like which is relatively non-conductive when compared to material such as steel from which the food handling and support portions of the tongs are provided. This will of course allow the user greater freedom when dealing with hot materials.

If should be obvious that applicant has provided a unique tong unit which is particularly designed for the handling of foods and the like and particularly for their insertion into deep rectacles such as canning jars and the like and wherein the particular handle arrangement for the tongs will permit usage of the same and pressure application to be made in-line with the mouth of the jar to be filled

What we claim is:

1. Tongs for handling food articles and the like, including:

a. a grasping portion including a pair of grasping elements, each said grasping element defining a generally rectangular, longitudinally extending section, said section defining an inwardly directed transverse curve and an inwardly directed longitudinal curve and a drainage aperture formed through said section;

b. a handle portion including a pair of handle elements;

c. a pair of longitudinally extending elements each respectively secured to a grasping element on one end thereof and a handle element on the other end thereof;

d. said support elements being pivotally connected to provide a scissor type connection therebetween; and, e. said pair of handle elements including a thumb receiving element having a passage arranged therethrough generally parallel to said support element and a finger receiving element having a passage arranged therethrough generally parallel to said support element.

2. The structure set forth in claim 1 and each of said grasping elements including at least one inwardly directed pincer member at the lower end thereof to engage with the pincer member of said other grasping element.

3. The structure set forth in claim 2 and a pair of inwardly directed pincer members at the lower end of each of said grasping elements arranged to engage the pincer elements on the other of said grasping elements when the tongs are in closed position.

4. The structure set forth in claim 3 and the area between said pincer members being arcuately formed.

5. The structure set forth in claim 1 and said handle elements having finger receiving receptacles defined therein, said receptacles being in longitudinal alignment with said supports.

6. The structure set forth in claim 1 and the passage of said finger receiving element including a finger receiving opening and a finger receiving ledge spaced from said opening.

7. The structure set forth in claim 6 and said finger receiving ledge being formed in said passage on the side thereof adjacent to said thumb receiving element.

8. The structure set forth in claim 1 and said finger receiving passage having a dimension thereacross to provide a wedging effect for the fingers when the fingers are received about said ledge.

9. The structure set forth in claim 1 and said passage in said finger receiving element being of a dimension to receive a plurality of fingers in side by side relation therein.

* * * * *